United States Patent [19]

Williams

[11] 4,085,846

[45] Apr. 25, 1978

[54] CONTAINERS ATTACHED TO PALLETS

[75] Inventor: John Williams, Leamington Spa, England

[73] Assignee: South Warwickshire Packaging Services Limited, Wellesbourne, England

[21] Appl. No.: 772,279

[22] Filed: Feb. 25, 1977

[30] Foreign Application Priority Data

Mar. 5, 1976 United Kingdom ..... 8957/76

[51] Int. Cl.[2] ..... B65D 19/20

[52] U.S. Cl. ..... 206/600; 108/55.1; 108/56.3; 217/43 A; 229/23 A; 229/23 C

[58] Field of Search ..... 229/23 A, 23 C, 55; 206/386, 600; 217/43 A; 108/51.3, 55.1, 561, 563

[56] References Cited

U.S. PATENT DOCUMENTS

| | | | |
|---|---|---|---|
| 2,085,239 | 6/1937 | Towell | 229/23 A |
| 2,502,384 | 3/1950 | Loth | 229/23 A |
| 2,741,361 | 4/1956 | Klein | 108/51.3 |
| 2,902,199 | 9/1959 | Breton | 206/386 |
| 3,063,593 | 11/1962 | Kuchenbecker | 229/23 A |
| 3,069,059 | 12/1962 | Des Bois | 108/51.3 |
| 3,756,498 | 9/1973 | Anderson | 229/23 C |
| 3,831,744 | 8/1974 | Walden et al. | 206/600 |
| 3,949,874 | 4/1976 | Heavner | 206/600 |

*Primary Examiner*—William Price
*Assistant Examiner*—Bruce H. Bernstein
*Attorney, Agent, or Firm*—Cushman, Darby & Cushman

[57] ABSTRACT

A container has a separately formed floor which is attached to a pallet. The floorless body of the container is placed on the pallet and trapped in position by the floor.

3 Claims, 4 Drawing Figures

CONTAINERS ATTACHED TO PALLETS

This invention relates to containers.

It is an objective of the present invention to provide a floored container which can readily and effectively be secured to a rigid base such as a pallet.

In accordance with the present invention the floor of the container is separately formed from the container body. The floor has a part securable to the rigid base and means extending inwardly from the container body are trapped between the floor and the base to fix the container to the base.

Thus the present invention provides a container assembly comprising a rigid base, particularly a pallet, a body and a separate floor having a part securable to the base and at least one part movable between a first position wherein the body can be fitted onto the base and a second position wherein the said part traps the body on the base thereby forming the container.

More specifically in accordance with the invention the body of a rectangular container has an inturned flange extended from the lower margin of each wall thereby defining a continuous rim. A cutaway is formed in the rim at each end of a line extending between the mid-points of opposite walls. These opposite walls will arbitrarily be designated side walls and the line a lateral line. The separately formed container floor is rectangular and comprises a narrow centre strip which in use extends along the said laterally extending line, the strip being slightly narrower than the cutaways, and front and rear flaps hingedly connected to the centre strip. In use with the strip fixed to a rigid pallet the flaps fold downwardly to provide a flat floor trapping the rim and locating the container on the pallet.

The invention will now be described by way of example and with reference to the accompanying informal drawings wherein.

Figure 1:
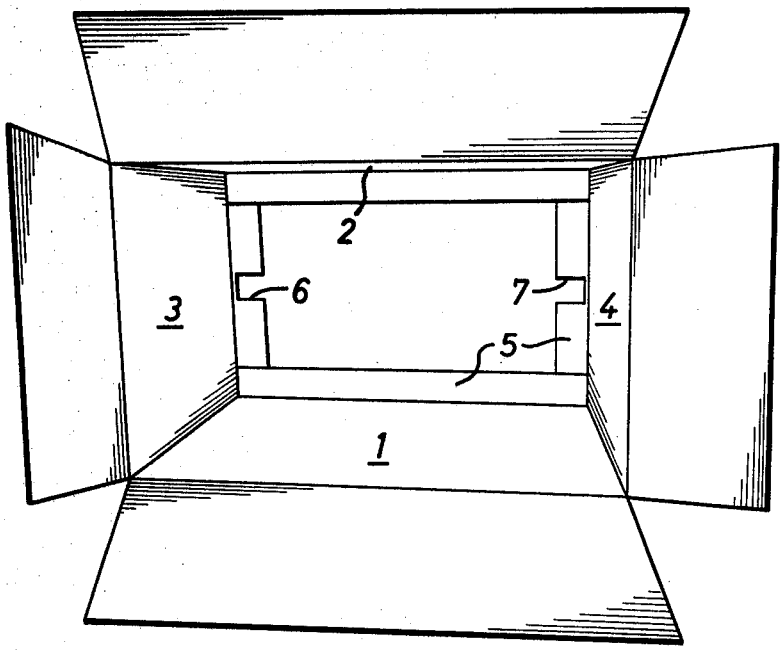
FIG. 1 is a plan view showing the body of the container without a floor.

Referring initially to FIG. 1 of the drawings the container body illustrated therein is made from folded fibre board. The body comprises front and rear walls 1 and 2 and side walls 3 and 4. The lower marginal part of each wall is inturned to define a flange 5, the flanges 5 defining together a continuous rim at the base of the body. A rectangular slot 6 is formed in the centre of the flange 5 at the base of side wall 3 and a similar slot 7 is formed in the centre of the flange 5 at the base of side wall 4. The lid arrangements form no part of the invention and will not be described.

Figure 2:
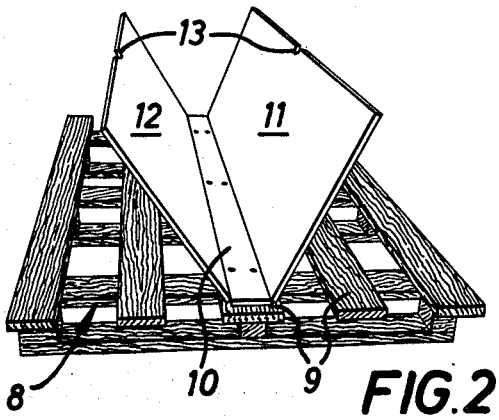
FIG. 2 is a perspective view showing the container floor fixed to a pallet base.

FIG. 2 shows a wooden pallet base 8 made of boards 9. The separately formed container floor also shown is formed of a foldable piece of fibre board and has a narrow central strip part 10 stapled or otherwise secured to a central board 9 of pallet base 8, the front and rear flaps 11 and 12 hingedly secured one to each long edge of strip.

Figure 3:
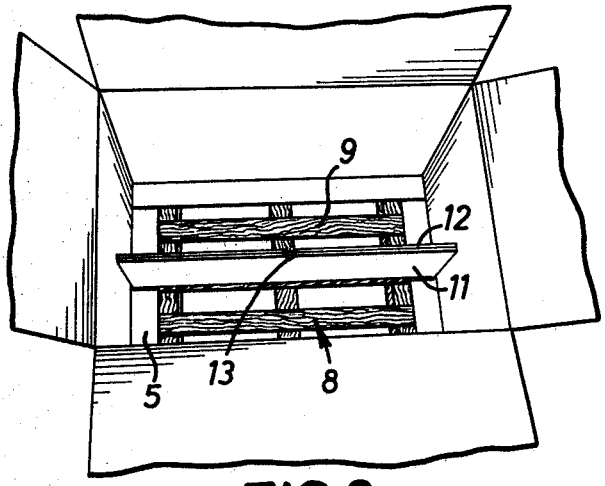
FIGS. 3 and 4 show the container floor being fixed to the body and hence the container being fixed to a pallet.
Figure 4:
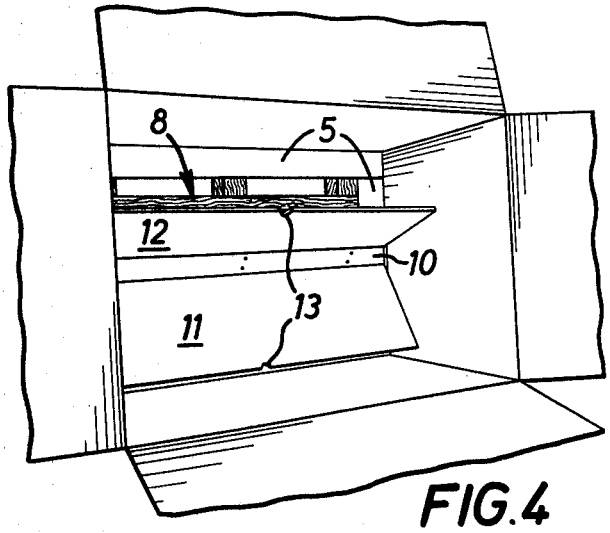

As can be seen from FIG. 3 flaps 11 and 12 are folded upwardly together to a first position and passed through slots 6 and 7 in flanges 5. The flaps 11 and 12 are than folded downwardly as illustrated in FIG. 4. When the flaps 11 and 12 are folded flat against pallet base 8 to a second position the flanges 5 are trapped thereby fixing the container to the pallet base. Loading the container enhances this trapping effect. Notches 13 in flaps 11 and 12 allow the flaps to be gripped and lifted if it is desired to dismantle the container reversing the operations described above.

It will be appreciated that the container described above is fixed to the wooden pallet base simply by securing the floor as described. The remaining erection operation consists simply of folding.

I claim:

1. A container assembly an originally separate rigid base;

a body of container board having a substantially continuous rim extending around the lower marginal part thereof, means defining a notch at each one of a pair of opposed locations on said rim, these two notches opening toward one another;

a floor defined by an intermediate part of container board stock secured to said base and having two opposed side edges, and a flap hingedly connected to each side edge of the intermediate part, the flaps being foldable to a first folded close together position wherein the body can be fitted on the base with each flap passing at the ends thereof through both of the notches in the rim and to a second, spread outwards position wherein the flaps, perimetrically thereof, except at said side edges trap the rim against the base thereby forming the container.

2. A container assembly comprising: a rigid pallet base;

a rectangular container body;

an inturned flange extended from the lower margin of each wall of the container defining a continuous rim;

a cutaway in the rim at each end of a lateral line extending between the mid-points of opposite walls;

a separately formed rectangular container floor comprising a narrow centre strip which, in use fixed to the rigid pallet, extends along the said lateral line; the strip being slightly narrower than the cutaways; and front and rear flaps hingedly connected to the centre strip, whereby the flaps can be folded upwardly to allow the body to be fitted onto the pallet;

the flaps passing through the cutaways and downwardly to provide a flat floor trapping the rim and locating the container on the pallet.

3. A container assembly comprising:

a rectangular fibre board box having two opposed upstanding side walls and an opposed upstanding front wall and rear wall, all joined at four respective corners;

an inturned flange extending from the base of the front wall; an inturned flange extending from the base of the rear wall;

means securing each inturned flange at both of the opposite ends thereof to the respective ones of said side walls at the respective bases thereof;

the two inturned flanges extending insufficiently toward one another to provide a complete bottom wall for said box and thereby defining a slot extending longitudinally substantially from one said side wall to the other said side wall at the respective bases of said side walls;

and a pallet sub-assembly, comprising:

a rigid, generally rectangular pallet base;

a generally rectangular fibre board box floor element including a central strip which is no broader than said slot is wide, and a pair of flaps hingedly secured along opposite side margins of said central strip; and fastener means securing the central strip centrally upon said pallet base;

said pallet sub-assembly being assembled to said box, by folding said flaps upwards relative to said central portion, inserting both said flaps through said slot from outside said box, then folding said flaps downwards until said floor element is generally planar, thus trapping the two respective inturned flanges between the respective flaps and said pallet base.

* * * * *